US005153922A

United States Patent [19]

Goodridge

[11] Patent Number: 5,153,922

[45] Date of Patent: Oct. 6, 1992

[54] TIME VARYING SYMBOL

[76] Inventor: Alan G. Goodridge, 1235 Wildwood #164, Sunnyvale, Calif. 94089

[21] Appl. No.: 648,293

[22] Filed: Jan. 31, 1991

[51] Int. Cl.[5] ..... G10L 7/10

[52] U.S. Cl. ..... 381/48

[58] Field of Search ..... 381/48; 84/464 R; 395/161, 140; 364/576

[56] References Cited

U.S. PATENT DOCUMENTS

| | | | |
|---|---|---|---|
| 2,500,646 | 3/1950 | Riesz | 381/48 |
| 4,641,343 | 2/1987 | Holland et al. | 381/48 |
| 4,669,097 | 5/1987 | Bristol | 381/31 X |
| 4,845,642 | 7/1989 | Itaya et al. | 395/140 |

*Primary Examiner*—Emanuel S. Kemeny
*Assistant Examiner*—S. A. Melnick
*Attorney, Agent, or Firm*—Larry D. Johnson

[57] ABSTRACT

An electrical process transforms an object electrical signal into a compact time-varying graphical representation whereby study of the time-varying spectral properties of said signal may be efficiently pursued. A time-varying symbol (TVS) includes means for providing first electrical signals representative of the time-varying magnitude spectrum of said object electrical signal, means for generating second electrical signals representative of the continuous variation in position and shape of a single graphical edge as a function of frequency, wherein said continuous variation in position and shape is such that all points inside some closed area within the output image are swept at more than one frequency within some continuous portion of the frequency range covered by said electrical process, and wherein said continuous variation in position and shape is such that no position and shape are repeated at more than one frequency throughout said continuous portion of said frequency range covered, and means for combining said first and second electrical signals into an output electrical signal representative of the weighted superposition of edges over all frequencies.

20 Claims, 4 Drawing Sheets

TIME VARYING SYMBOL

BACKGROUND OF THE INVENTION

1) Field of Invention

The present invention pertains generally to the field of spectrum analysis, and more particularly to the field of compact graphical representations of time-varying spectra. The invention is rooted in the field of speech analysis and speech parameter display.

2) Description of Prior Art

A series of devices were developed during the Second World War which may collectively be termed the sound spectrograph. Such devices were the first to automatically plot energy versus frequency over successive short-time intervals and were of particular value in the study of speech patterns. Frequency is plotted in the ordinate proceeding from zero frequency at the bottom to high frequency at the top, time is plotted in the abscissa proceeding from left to right as in printed matter, and energy is represented by the darkness in the plot at any given point. The resulting graphical format is compact in the space-filling sense of the term, and in principle all of the magnitude spectrum information is retained. There also exist real-time sound spectrographs which show a succession of such plots over time, as though a window of fixed temporal width were being swept across a wider static plot.

In another area of speech analysis the object is to transcribe speech into a sequence of symbols, i.e. discrete graphical entities typified by alphabetical characters, in which the transcription is based upon the so called phonemes of a language. The complexity of the output is preferred to be approximately that of a phonetic transcription as would be provided by a trained listener, will allophonic variations possibly indicated by the presence or absence of certain additional marks in the vicinity of the symbol. The resulting graphical format is considerably more compact than that of the sound spectrograph, but due to categorizing processes not all of the magnitude spectrum information is retained. Compactness in the abstract is gained while compactness in the space-filling sense of the term is lost.

Due to an obvious incompatibility with symbol strings as are used to represent the phoneme sequences of actual languages, the equation of single short-time spectra with single symbols has gone essentially unstudied. It will be seen, however, that such an equation does indeed carry validity in the context of time-varying output, and that a proper choice of transform allows retention of all magnitude spectral data as well as retention of the space-filling type of compactness. It is an object of the present invention to provide a symbolic continuum in which instantaneous variations in shape reflect instantaneous variations in the magnitude spectrum.

A third area of speech analysis in which the descriptions are remarkably compact is known as linear predictive coding. LPC is a group of digital signal processing techniques which were developed in the early nineteen seventies and which remain the most compact parametric mathematics known for the problem. LPC allows the rapid and efficient decomposition of speech signals into an all-pole transfer function which represents the filtering characteristics of the vocal tract, and a source function which regenerates the original speech signal when passed through the filter so derived. Magnitude spectrum information is thrown out when the LPC source function is represented incompletely, for example with the parameters system gain, periodicity versus randomness, and pitch when necessary. It is the algebraic or parametric nature of the complex polynomial form which is most central to the compactness of LPC representations, and one may thus refer to an algebraic or parametric type of compactness. It is an object of the present invention to allow the compact representation of unordered sets of complex numbers as single symbols, the compact representation of unordered sets of real numbers as single symbols, and the compact representation of single points in confined multidimensional subspaces as single symbols.

There are very many potential uses for such systems. Although the inputs are generally thought of as audio signals derived from microphones or from audio reproduction equipment, any electrical wave of analog origin having time-varying spectral content may substitute; an efficient representation will result as long as the frequency range has been shifted to that of audio. In many areas of science the raw data that results from an experiment consists of an electrical signal having time-varying spectral content, and so the first applications to be mentioned are in the viewing of data gathered during the course of physical experiments. Analysis of data from any region of the electromagnetic spectrum may be performed after an appropriate shifting of frequencies. The benefit over current spectrum analysis methods is that temporal relationships are placed in clearer evidence. To the experimenter, time becomes time. TVS may be used as a tool for performing a preliminary search of the data, and in certain situations its use may be appropriate in the final description.

A prime example of the need to place temporal relationships in clearer evidence is to be found in speech science. Coarticulation is said to be a set of exceptions to a set of rules, but coarticulation is the rule and not the exception. The use of an instrument that is suited to tracking acoustic phenomena over time can shed new light on the complex problems underlying the description of coarticulation. Filtering operations may be perfomed on the input in order to highlight the importance of specific formant trajectories, fricative resonances, plosive transients, or transitions between voicing and frication. The resulting graphical comparisons may be used in teaching of linguistics and foreign language skills, with students having the opportunity to approximate the images using their own voice. For speech-impaired individuals including the deaf, the time-varying symbol may offer a therapeutic option that is highly reliable and trustworthy, from the point of view of the student. Students may be struck by the reproducibility of their own results and seek to pursue the course of learning.

SUMMARY OF THE INVENTION

The present invention consists in representing the power in an electrical wave at any given frequency by the strength of a single graphical edge, wherein the position and shape of this edge are varied continuously such that all points in the output image are swept at more than one frequency and such that no shape is repeated at more than one frequency. The output is nominally defined as the weighted superposition of edges over all frequencies, an integration in the case of analog images and spectra or a summation in the case of digital images and spectra:

$$V(i,j)=\Sigma E(i,j,k)S(k)$$

where V(i,j) is the output at row i and column j, E(i,j,k) is the image intensity of the edge function at row i and column j as a function of frequency k, and S(k) is the spectrum. In the Fourier Transform the component frequency functions are orthogonal in the mathematical sense of the term, and yet during measurements the power at nearby frequencies is in general highly correlated. A similar property holds over edges whose position and shape are varied in accordance with the stated constraints: the juxtaposition of two edges far enough apart in frequency is orthogonal in the perceptual sense of the term, and yet as $\Delta f \rightarrow 0$ the two edges are constrained to be of highly correlated position and shape.

An example will help to clarify what is meant by the stated constraints on position and shape variation. The position and shape of an edge may be caused to vary continuously as depicted in FIG. [1]. As the square window 101 is swept from left to right over the edge function 102, the position with respect to the window frame 101 of the selected portion of the edge function 102 is seen to vary continuously. Shape varies continuously due to growth of the edge at the right of the frame 122 and dwindling of the edge at the left of the frame 121. The window is relatively small compared to the total extent of the static edge function, and the derivative of distance swept with respect to the logarithm of frequency is held constant. In the special case of translation in a constant direction on the output image is seen to consist of a family of correlation functions, as exemplified by the case of translation from left to right in FIG. [1] under the assumption of digital images and spectra:

$$V(j)=\Sigma E(k)S(k-j)$$

where V( ) is one row of the output image, E( ) is one row of the static edge function, and S( ) is the log frequency spectrum. Each row of the output image consists of a portion of the correlation function between the log frequency spectrum and the corresponding row of the static edge function. A transformation of coordinates would be required to obtain the family of inputs to the correlations if window translation were not in the direction of one of the axes.

Note that use of a logarithmic frequency scale 131 as depicted in FIG. [1] causes edges in the output due to spectral components one octave apart 132 to have a tendency to be at right angles, edges in the output due to spectral components two octaves apart 133 to have a tendency to reinforce one another, and so on. In experiments to date, the static edge functions have been constructed by joining diagonally opposite points in a square grid 103 using circular arcs 141, straight diagonal lines 142, straight vertical lines 143, straight horizontal lines 144, and slightly curved approximations to staircase functions 145. Note that alphabetical symbols in general can be described using these or similar primitives, and note that in a sequence of alphabetical symbols there are strong tendencies toward perpendicularity and parallelism of edges.

Note that, given inputs containing harmonic striation, the use of a logarithmic frequency scale as depicted in FIG. [1] produces a direct correspondence between input frequency and spatial frequency in the axis of window translation. The characteristic exponent with which magnitude decays with frequency is known to have significance in both acoustic and spatial domains. Note lastly for the example given that there is vertical symmetry in both the static edge function and output image, but that this need not be the case. Lateral symmetry may be induced by forming only the left or right half of the output and taking the other half to be its mirror reflection.

Consider, finally, the LPC transfer function as a substitute for the unprocessed spectrum of the original signal. The smoothly varying magnitude of the complex polynomial could itself be used, or some other parametric curve could be obtained to replace it. Of particular interest are the roots of the polynomial. Each pole which does not lie on the real axis may along with its conjugate be said to describe some kind of discrete resonance, and the parametric curve may accordingly show localized energy with sharpened contours, such as a set of impulse functions or square waves centered about the pole frequencies. The result is something much more like a traditional alphabetical symbol and shares with it the failure to convey intonational information. In general, magnitude spectrum information will be lost unless the spectrum of the source signal is somehow represented completely. To take matters a step further the edges may be constrained to be of uniform darkness and thickness, with pole gain corresponding instead to edge length. To take matters yet another step further, and to obtain the result for unordered sets of real numbers, the edges may be constrained to be of uniform darkness and thickness as well as of constant length. In either case the output may be formed as the boolean OR of constituent edges as long as the edges are relatively thin and few in number. The extensions to single points in confined multidimensional subspaces would require discontinuities in the variation of position and shape, specifically a number of discontinuities equal to the number of dimesions in the space less one.

DESCRIPTION OF PREFERRED EMBODIMENT

Figure 1:
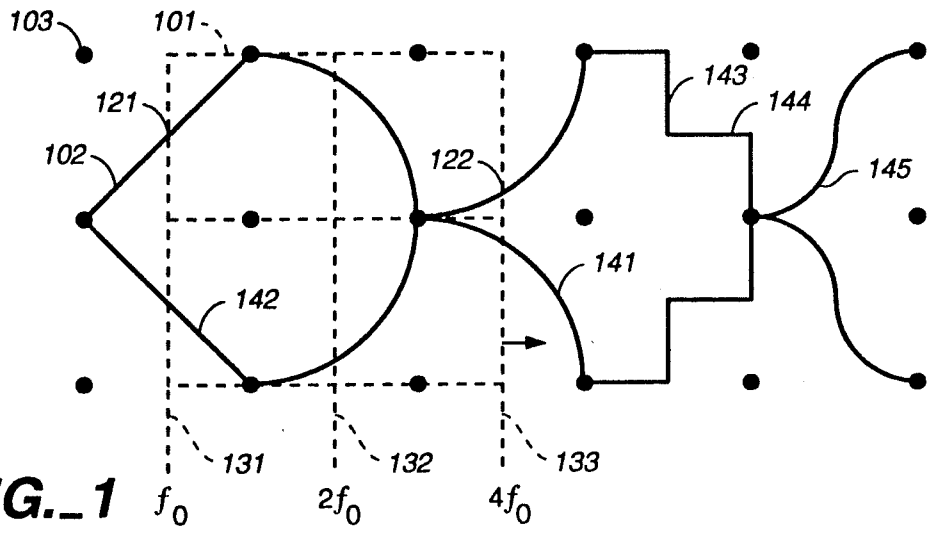
FIG. 1 illustrates an example of the continuous variation of position and shape with frequency which makes use of a static edge function and a logarithmic frequency scale. The options of vertical and lateral symmetry are also depicted.
Figure 2:
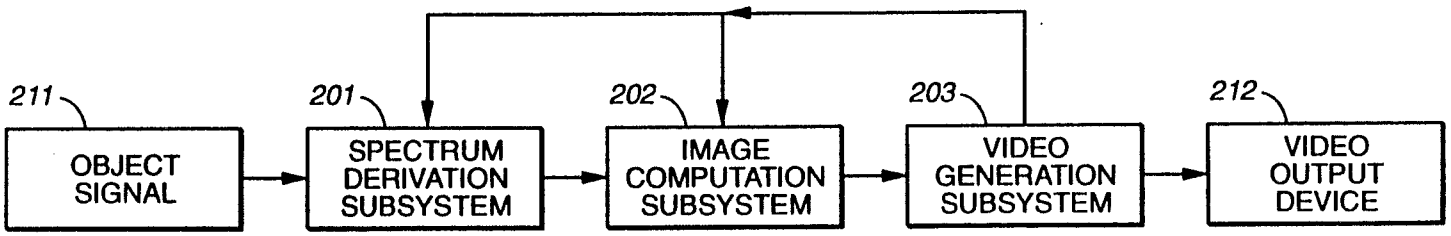
FIG. 2 is a block diagram which shows how an overall system may be broken down into three constituent subsystems, and shows the input and output of such an overall system. System control is shown arising from the video generation subsystem, which contains the system clock.
Figure 3:
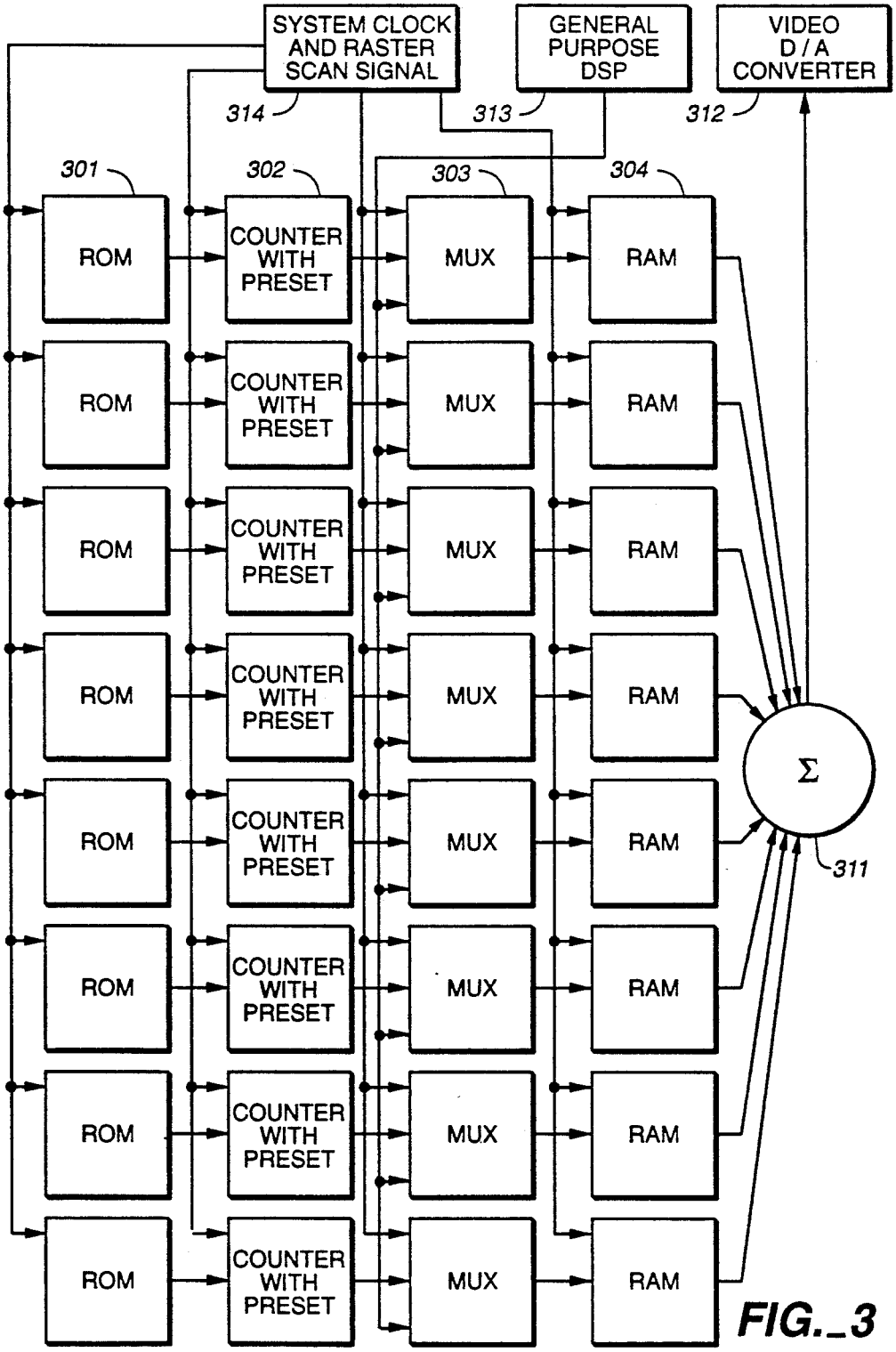
FIG. 3 shows the hardware block diagram for the image computation subsystem of the specific embodiment described. It consists of eight separate channels of digital hardware which operate in parallel and whose outputs are summed in real time.
Figure 4:
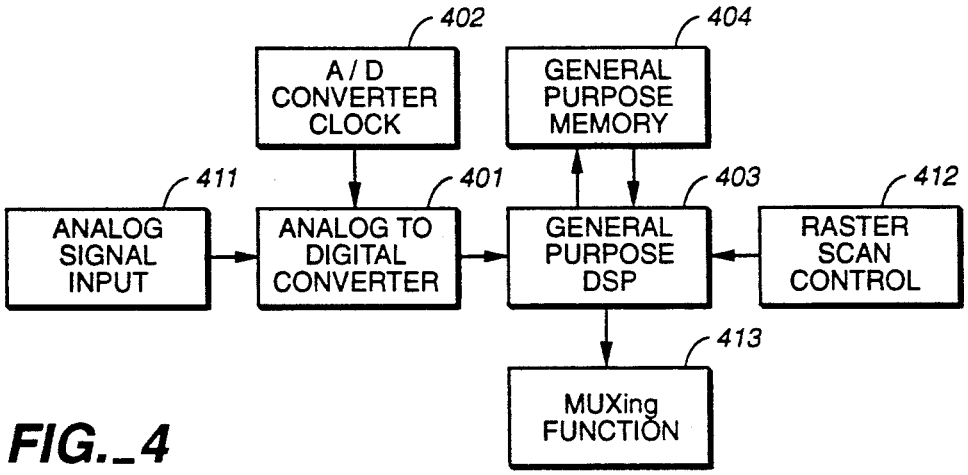
FIG. 4 shows a hardware block diagram which briefly characterizes how a general purpose digital signal processor might be used in the implementation of a spectrum derivation subsystem. Also shown are an analog input, the data path by which spectra are output, and the external control of frame rate.
Figure 6:
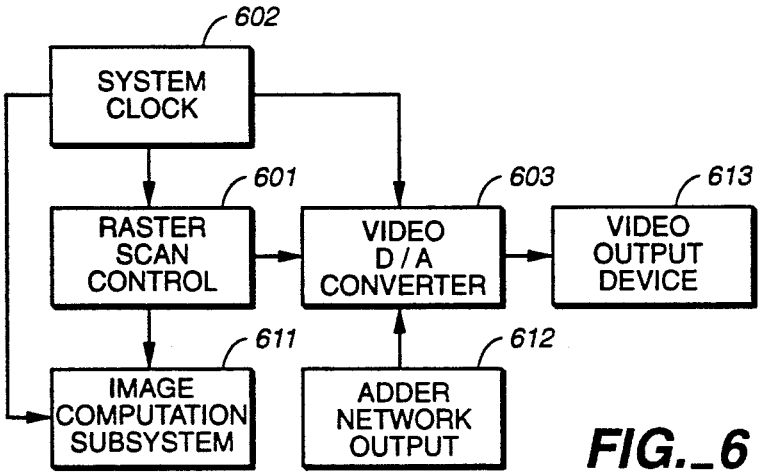
FIG. 6 shows a hardware block diagram outlining the elements of a video generation subsystem, as required in the specific embodiment described. A source of control signals is depicted for synchronizing the hardware structures of the image computation subsystem with video output.
Figure 5:
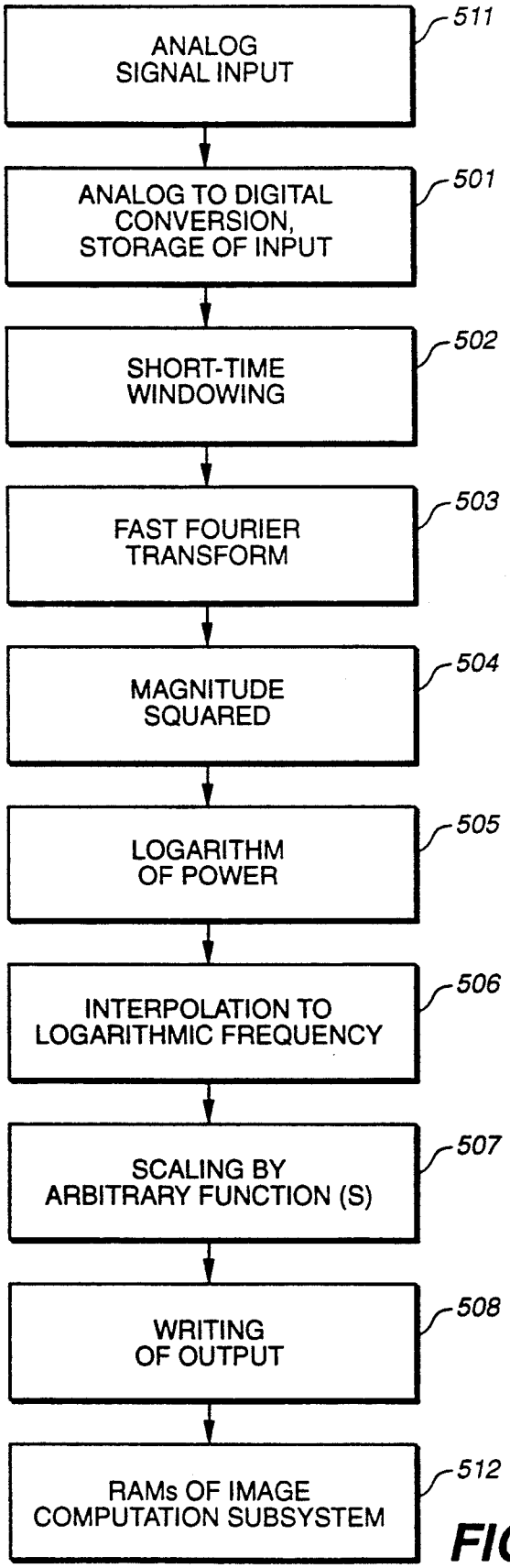
FIG. 5 shows an algorithmic flow chart which briefly characterizes one particular sequence of front end processing functions which could be used in the implementation of a spectrum derivation subsystem, for example with the use of a general purpose digital signal processor.

The preferred embodiment to be described is an embodiment in electrical hardware. It is expected that the systems most useful in laboratory environments will run in real time, to which end a practical system has been defined and reduced to the level of hardware building blocks. Modifications to this hardware which give rise to greatly expanded processing power may be achieved quite readily. The system described uses position and shape variation as depicted in FIG. [1], including the square window being swept from left to right, including the use of correlation functions, including the construction of edge functions by joining diagonally opposite points in a square grid, and including the options of vertical and lateral symmetry. The system may span up to roughly eight octaves of analysis when a logarithmic frequency scale is used, and allows the continuous variation of color with frequency as a further option.

The system described uses static edge functions eight squares in width wherein square is defined to mean 64 by 64 array of pixels containing a single graphical edge. Each edge is classified as either Z-type or N-type wherein Z-type edges proceed from bottom left pixel to top right pixel and N-type edges proceed from top left pixel to bottom right pixel. A static edge function is defined to consist of the concatenation of eight squares from left to right beginning with a Z-type edge and proceeding alternately thereafter with N-type and Z-type edges. A single row of the static edge function may then be defined as E(j), j=0.511. As the square window is swept from left to right across the static edge function in one-pixel increments it is seen that exactly 575=512+64−1 distinct nonzero contributions to the superposition exist. Defining the spectrum as S(j), j=0.574, and defining a single row of the output image as V(j), j=0.63, the equation expressing each row of the output image as a portion of the correlation function between the spectrum and the corresponding row of the static edge function becomes:

$$V(j) = \sum_{K=0}^{511} E(k)\, S(k + 63 - j) \text{ for } j = 0..63.$$

Static edge functions are further constrained in the present system so that function values are either unity or zero and so that edges are one pixel wide in the sense of there being one and only one blackened pixel per row per edge. Far superior image quality is eventually to be expected from the use of grayscale edge functions, which would likely entail the use of techniques equivalent to fast convolution. Under the present constraints the function E(k) will for any given row take the value of unity for exactly eight values of k and take the value of zero elsewhere. Defining said set of values as k(c), c=0.7, the equation expressing each row of the output image as a portion of the correlation function between the spectrum and the corresponding row of the static edge function becomes:

$$V(j) = \sum_{C=0}^{7} S(k[c] + 63 - j) \text{ for } j = 0..63.$$

The hardware implements this equation directly by summing the outputs from eight separate channels of data in real time. The output image is generated in raster scan order, i.e. V(0) is generated first for any given row, followed by V(1), V(2), and so on up to V(63). If the option of lateral symmetry is in force then the process is reversed after reaching V(63) to regenerate V(62), V(61), and so on back down to V(0). Row 0 is generated first for any given frame, followed by row 1, row 2, and so on up to row 63; if the option of vertical symmetry is in force then the process is reversed after completing row 63 to regenerate row 62, row 61, and so on back down to row 0.

Each channel of data contains the spectrum values arranged into the consecutive locations of a Random Access Memory such that the eight memories' contents are identical and constant throughout the generation of any given output image. Each row is fully characterized by the set of eight initial addresses k[c]+63, c=0.7, defining the RAM locations whose contents are to be summed in the computation of V(0). Decrementing all eight RAM addresses by 1 then causes the RAMs to output the values whose sum is equal to V(1), and so on, until the 63rd decrement causes the RAMs to output the values whose sum is equal to V(63). Lateral symmetry is handled by switching to incrementation instead of decrementation.

FIG. [3] shows the hardware block diagram consisting of a network of adders 311 fed by eight identical RAMs 304, with the RAMs 304 in turn controlled by eight identical addressing mechanisms: throughout the generation of any given image the RAMs 304 will be addressed solely by means of the presettable counters 302; the multiplexing functions 303 allow for the data in the RAMs 304 to be replaced between images. The driving component of each data channel is a Read Only Memory 301 addressed by image row and containing the preset values k[c]+63, c fixed, row=0.63. The counters 302 which provide the addresses into RAM 304 are preset with values from ROM 301 prior to the initiation of processing for any given row. Vertical symmetry is handled by using duplicate data instead of unique data in the latter halves of the ROMs 301. The adder network 311 provides a single video output to the video digital to analog converter 312.

FIG. [2] shows an overall system broken into three subsystems: the spectrum derivation subsystem 201, the image computation subsystem 202, and the video generation subsystem 203. It is necessary to periodically update the representation of the spectrum contained in the RAMs 304 of FIG. [3] in accordance with the time-varying character of some input signal, and it is necessary to provide certain signals to control the timing of data through the eight hardware channels of FIG. [3], certain signals to control the periodic transfer of the spectrum into the RAMs 304 including control of the multiplex function 303, and certain signals to drive a raster scan video output device.

The operation and control of raster scan video is well understood; all such control signals for the system described are grouped into a generic block labeled system clock and raster scan control 314, corresponding to system clock 602 and raster scan control 601 of FIG.

[6]. Raster scan control is taken to be based upon the explicit use of row and column counting so that row counter output is available as the address input to the ROMs 301 of FIG. [3], all other control signals needed are such as may be based upon the decoding of row and column counter outputs. The remainder of FIG. [6] shows video digital to analog converter hardware 603 receiving input from the adder network of the image computation subsystem 612 and driving a raster scan video output device 613, all under raster scan control 601. A system clock 602 provides global synchronization, clocking the column counters of raster scan control 601, providing the pixel rate of video digital to analog conversion 603, and driving all circuits in the eight hardware data channels of the image computation subsystem 611.

The derivation of consecutive short-time spectra for an audio input is a vast subject in its own right; the system described requires only that the hardware be able to write consecutive sequences of 574 values into the group of eight RAMs 304 of FIG. [3] which appear as a single address space to the general purpose DSP 313. The RAMs 304 are taken to have separate data paths for input and output, and the multiplex function 303 is taken to be controlled by a signal or signals from raster scan control 601. The hardware block diagram of FIG. [4] is included as a brief characterization of how general purpose digital hardware might be organized to implement a spectrum derivation subsystem: an analog to digital converter 401 under independent clock control 402 converts an analog input signal 411 into digital form and interrupts a general purpose digital signal processor 403 at the sampling rate. The digital signal processor 403 makes use of general purpose external memories 404 as it performs a programmed sequence of front end processing functions. New spectral data is output once per frame to the multiplexing function of the image computation subsystem 413 under raster scan control 412. The algorithmic flow chart of FIG. [5] is included as a brief characterization of one particular sequence of front end processing functions that could be used; it consists of analog to digital conversion with storage 501 of the input 511, short-time windowing 502, Fast Fourier Transform 503, magnitude squared operation 504, log power operation 505, interpolation to log frequency 506, scaling by one or more arbitrary functions 507, and output 508 to the RAMS of the image computation subsystem 512. In order to produce output in which color varies continuously with frequency the arbitrary scaling 507 would be performed separately for each of red, green, and blue. Each of the three resulting spectra would then be written to separate instances of the image computation hardware, and all three instances of the image computation hardware would run in parallel to produce an RGB output. Varying the color of the edges with frequency is basically a means of channel separation.

A number of problems are seen to arise from the implementation of position and shape variation by means of static edge functions. In the above described system, edges were one pixel wide in the sense of there being one and only one blackened pixel per ordinate value per edge, which clearly makes difficult the inclusion of horizontal edges. This problem is not limited to the case of a purely horizontal edge, but is locally present in all of the edges to the degree that an edge is horizontal at each point, as can be seen by considering the shape produced by a narrowband resonance. These problems are due essentially to the fact that edge translation has components in the direction of the tangent to the edge, i.e. not in the direction of the normal to the tangent, at some places on the edge. It may also be noted that an uneven use of area will result from the deviations from straight diagonal which are necessary when constructing edges by joining points in the square grid, and it may be noted furthermore that spatial frequency distributions characteristic in only one particular axis are unnatural.

A solution to these problems may be approached by noting that, due to definitional discontinuities in the "single" edge at the grid points, there are really two edges present at any given frequency; the edge for any given octave of analysis starts out with a length of zero at some base frequency, increases in length until it reaches a maximum at a frequency one octave higher, then decreases in length until its length is again zero after another doubling in frequency. The total contribution to the output at any given frequency is due to the superposition of two components which happen always to share one endpoint. By relaxing the requirement that the two components always share one endpoint, it is clearly possible to provide definitions of position and shape variation in which edge translation occurs pimarily if not solely in the direction of the normal to the tangent; the question is how best to approximate certain ideals without violating certain others.

Two types of position and shape variation in which edge translation is solely in the direction of the normal to the tangent, and in which length proceeds from zero up to a maximum and back down to zero, come immediately to mind: the case of a straight line which moves through a frame in a constant direction, and the case of an expanding circular arc. Consider first the traversal of the straight edge from one corner of a square frame to the opposite corner. Letting r be the distance of traversal and k be the length of the side of the square, the length function is:

$$I=2r, r=0.k\sqrt{2}/2,$$

$$I=k\sqrt{2}-2(r-k\sqrt{2}/2)=2(k\sqrt{2}-r), r=k\sqrt{2}/2.k\sqrt{2},$$

There are two distinct orientations available for use, specifically the two which result in straight diagonal edges. Two additional orientations are made available, specifically those which result in straight horizontal and vertical edges, by rotations of the frame in either direction by $\pi/4$ radians. Note that length proceeds linearly in r from zero up to a maximum of $k\sqrt{2}$, then linearly from the maximum back down to zero; other orientations of the direction of edge traversal with respect to the frame would produce halves of length functions which are only piecewise linear, and which become discontinuous in the extreme of an edge which is parallel to the side of the frame it must disappear into. Note that nonlinear halves of length functions would result from the use of a circular frame:

$$I=2\sqrt{(kr-r^2)}, r=0.k.$$

Consider next the expanding circular arc which begins in one corner of a square frame. The length function is:

$$I=\pi r/2,\ r=0.k,$$

$$I=2r[\pi/4-\cos^{-1}(r/k)], r=k.k\sqrt{2},$$

with four distinct orientations available for use before resorting to rotations of the frame. Note the nonlinearity of $I=2r[\pi/4-\cos^{-1}(r/k)]$, and note that $k\sqrt{2}/2$, not k, is the value of r which lies halfway through the interval $0.k\sqrt{2}$. It is possible to remedy this with the definition that arc length decrease linearly in the range $r=k\sqrt{2}/2.k\sqrt{2}$, resulting in a maximum length of $(\pi/4)k\sqrt{2}$ instead of $\pi k/2$, and having the consequence that not all points in the output image will be swept in the trajectory of the edge. Note that nonlinear halves of length functions would again result from the use of a circular frame, with the exact form of the length function depending upon the location of the origin of the circle with respect to the frame.

In formulations of position and shape variation described above, the aesthetic ideal of equal Euclidean distances between the points at which length is zero has been met, but the aesthetic ideal of equal maximum lengths has not. Equal maximum lengths could be insured either by expanding the square frame in the cases of circular arcs so that $r=k\sqrt{2}/2$ at the halfway point, resulting in violation of the ideal of equal Euclidean distances, or by using a parallelogram frame in place of the square frame in the cases of straight edges, resulting in further violation of the ideal that all points in the output image be swept in each edge trajectory.

These discussions are by no means an attempt to be complete, but rather as an introduction to some of the issues that are encountered in the design of suitable means of position and shape variation; the best formulations must necessarily await the results of psychophysical experiments and the introduction of further variables. One very important variable which has not been discussed is the ratio of the distance traversed over one octave to some measure of the size of the frame, given for example by the ratio $(k\sqrt{2}/2)/k=\sqrt{2}/2$ in the above formulations, as compared to the ratio $k/k=1$ which arises in the case of static edge functions as treated. Another variable which is obviously very important is the ease of implementation in digital hardware. It may be noted that only minor modifications to the addressing mechanisms of FIG. [2] are necessary to implement the above formulations of position and shape variation: the distance of traversal r may be computed as a function of pixel row and pixel column in real time and then used to address the RAMs, resulting in a form of edge definition in which the "jaggies" may be eliminated through the use of interpolation. Certain aesthetic ideals must be settled upon as the basis for a design, and then others approximated as closely as possible.

What is claimed is:

1. An electrical process for transforming an object electrical signal into a compact time-varying graphical representation whereby study of the time-varying spectral properties of said object electrical signal may be efficiently pursued, comprising:

means for providing first electrical signals representative of the time-varying magnitude spectrum of said object electrical signal;

means for generating second electrical signals representative of the continuous variation in position and shape of a single graphical edge as a function of frequency, wherein said continuous variation in position and shape is such that all points inside some closed area within a generated output image of the graphical representation are swept at more than one frequency within some continuous portion of the frequency range covered by said electrical process, and wherein said continuous variation in position and shape is such that no position and shape are repeated at more than one frequency throughout said continuous portion of said frequency range covered; and means for combining said first and second electrical signals into an output electrical signal representative of the weighted superposition of edges over all frequencies.

2. An electrical process according to claim 1 wherein said continuous variation in position and shape is such that all points in the output image are swept at more than one frequency within said continuous portion of said frequency range covered, and wherein said continuous variation in position and shape is such that no position and shape are repeated at more than one frequency throughout said continuous portion of said frequency range covered.

3. An electrical process according to claim 1 wherein said transforming of the object electrical signal is not performed in real time.

4. An electrical process according to claim 1 wherein said variation in edge position and shape with frequency is augmented by variation in edge color with frequency.

5. An electrical process according to claim 1 wherein said first electrical signals representative of the time-varying magnitude spectrum consist in electrical signals representative of a time-varying power spectrum, electrical signals representative of a time-varying log magnitude spectrum, or electrical signals representative of a time-varying log power spectrum.

6. An electrical process according to claim 1 wherein said first electrical signals representative of the time-varying magnitude spectrum consist in electrical signals representative of a time-varying log frequency spectrum.

7. An electrical process according to claim 1 wherein said first electrical signals representative of the time-varying magnitude spectrum consist in electrical signals representative of a time-varying polynomial transfer function resulting from linear predictive analysis.

8. An electrical process according to claim 7 wherein said first electrical signals representative of the time-varying magnitude spectrum consist in electrical signals representative of the time-varying spectrum of a source function resulting from linear predictive analysis in addition to electrical signals representative of the time-varying polynomial transfer function resulting from said linear predictive analysis.

9. An electrical process according to claim 1 wherein said second electrical signals representative of the variation in position and shape of a single graphical edge consist in electrical signals representative of the traversal of a window across a static edge function, wherein said window is of relatively small extent by comparison to the total extent of the static edge function.

10. An electrical process according to claim 9 wherein said static edge function consists in a set of edges constructed by joining diagonally opposite points in a square or rectangular grid.

11. An electrical process according to claim 10 wherein traversal of said window across said static edge function consisting in said set of edges constructed by joining diagonally opposite points in said square or rectangular grid is such that, in a process making use of a log frequency spectrum, the length in the axis of translation of one side of said square or rectangle represents a doubling in frequency.

12. An electrical process according to claim 9 wherein the computation of the output, either by analog or by digital means, is performed by computing, either by analog or by digital means, a set of portions of correlation functions.

13. An electrical process according to claim 12 wherein computation of said output, either by analog or by digital means, is performed in raster scan order.

14. An electrical process according to claim 12 wherein said correlation functions are computed by means including some fixed number of separate channels of digital hardware wherein each such channel is equivalent in structure and function to each other such channel and wherein all such channels operate in parallel.

15. An electrical process according to claim 1 wherein said second electrical signals representative of the variation in position and shape of a single graphical edge consist in electrical signals representative of, in combination, straight lines moving through square frames in constant directions and expanding circular arcs in square frames.

16. An electrical process according to claim 15 wherein said combinations of straight lines and expanding circular arcs are such that at any given frequency the single graphical edge consists of two pieces of which the length of one is either zero or increasing or maximum and of which the length of the other is either maximum or decreasing or zero.

17. An electrical process according to claim 16 wherein said combinations of straight lines and expanding circular arcs, consisting in said two pieces at any given frequency, are such that, in a process making use of a log frequency spectrum, a length of traversal of said straight line or expanding circular arc equal to one half the length of the diagonal of one side of said square frame represents a doubling in frequency.

18. An electrical process according to claim 15 wherein the computation of the output, either by analog or by digital means, is performed by computing, either by analog or by digital means, a set of frequencies as a function of x and y coordinates which determine spectral values to be summed into a single output value.

19. An electrical process according to claim 18 wherein computation of said output, either by analog or by digital means, is performed in raster scan order.

20. An electrical process according to claim 18 wherein said computations are performed by means including some fixed number of separate channels of digital hardware wherein each such channel is equivalent in structure and function to each other such channel and wherein all such channels operate in parallel.

* * * * *